US008488294B2

(12) United States Patent
Schwiebert et al.

(10) Patent No.: US 8,488,294 B2
(45) Date of Patent: Jul. 16, 2013

(54) IONIC FLUID FLOW ACCELERATOR

(75) Inventors: Matthew Schwiebert, San Jose, CA (US); Kenneth Honer, San Jose Santa Clara, CA (US); Nels Jewell-Larsen, Campbell, CA (US)

(73) Assignee: Tessera, Inc., San Jose, CA (US)

( * ) Notice: Subject to any disclaimer, the term of this patent is extended or adjusted under 35 U.S.C. 154(b) by 44 days.

(21) Appl. No.: 12/427,048

(22) Filed: Apr. 21, 2009

(65) Prior Publication Data

US 2009/0261268 A1 Oct. 22, 2009

Related U.S. Application Data

(60) Provisional application No. 61/046,792, filed on Apr. 21, 2008.

(51) Int. Cl.
*H01T 18/02* (2006.01)
*H05F 3/06* (2006.01)

(52) U.S. Cl.
USPC ..... 361/230; 361/231; 361/233; 361/229

(58) Field of Classification Search
USPC ..... 361/230, 231, 233, 225, 229; 422/186.04; 204/164; 55/DIG. 1, DIG. 38
See application file for complete search history.

(56) References Cited

U.S. PATENT DOCUMENTS 2,765,975 A * 10/1956 Lindenblad ..... 315/111.91
3,089,079 A * 5/1963 Milligan ..... 322/2 R
3,236,442 A * 2/1966 Davis et al. ..... 417/49
3,309,873 A * 3/1967 Cann ..... 60/203.1
4,227,894 A * 10/1980 Proynoff ..... 96/58
4,230,466 A * 10/1980 Michel ..... 96/90
2005/0082160 A1 * 4/2005 Botvinnik ..... 204/164
2006/0203416 A1 9/2006 Taylor et al.

FOREIGN PATENT DOCUMENTS

WO 2005037420 A2 4/2005
WO 2006039562 A2 4/2006

OTHER PUBLICATIONS

International Search Report and Written Opinion mailed Oct. 29, 2009 in App. No. PCT/US2009/041209, 8 pages.
Webster's Third New International Dictionary Unabridged. Merriam-Webster. 2002, p. 433 (evidence for record on appeal of accepted definition for "coaxial" and "coaxially").

* cited by examiner

*Primary Examiner* — Rexford Barnie
*Assistant Examiner* — Zeev V Kitov

(57) ABSTRACT

An electrohydrodynamic fluid accelerator apparatus includes a corona electrode having an axial shape and configured to receive a first voltage. The electrohydrodynamic fluid accelerator apparatus includes a collector electrode disposed coaxially around the at least one corona electrode and configured to receive a second voltage. Application of the first and second voltages on the corona electrode and the collector electrode, respectively, causes fluid proximate to the corona electrode to ionize and travel in a first direction between the corona electrode and the collector electrode, thereby causing other fluid molecules to travel in a second direction to generate a fluid stream. In at least one embodiment of the invention, the ionized fluid proximate to the emitter electrode travels in a radial direction from the corona electrode to the collector electrode, causing the other fluid molecules to travel in an axial direction to thereby generate the fluid stream.

28 Claims, 6 Drawing Sheets

IONIC FLUID FLOW ACCELERATOR

CROSS-REFERENCE TO RELATED APPLICATION(S)

This application claims benefit under 35 U.S.C. §119(e) of provisional application No. 61/046,792, filed Apr. 21, 2008, entitled "Collector Structure for Ionic Air Flow Accelerator," naming Matt Schwiebert and Kenneth Honer as inventors, which application is incorporated herein by reference in its entirety.

BACKGROUND

1. Field of the Invention

The subject matter of the present application is related to a type of electrohydrodynamic (also known as electro-fluid-dynamic) technology that uses corona discharge principles to generate ions and electrical fields to control the movement of fluids such as air, or other types of fluids, and more particularly to embodiments of collector structures in an ionic air flow accelerator device.

2. Description of the Related Art

Principles of the ionic movement of fluids include ion generation using a first electrode (often termed the "corona electrode" or the "corona discharge electrode") that accelerates the ions toward a second electrode, thereby imparting momentum to the ions in a direction toward the second electrode. Collisions between the ions and an intervening fluid, such as surrounding air molecules, transfer the momentum of the ions to the fluid inducing a corresponding movement of the fluid to achieve an overall movement in a desired fluid flow direction. The second electrode is variously referred to as the "accelerating," "attracting," "collector," or "target" electrode. By placing successive arrays of first and second electrodes, the ions are continually accelerated and collide with additional air molecules until they lose their charge, either to air molecules or to the collector electrodes in their path.

Devices built using principles of the ionic movement of fluids are variously referred to in the literature as ionic wind machines, corona wind pumps, electrostatic air accelerators and electrohydrodynamic thrusters. In the present application, such devices are referred to as ionic air flow accelerators.

SUMMARY

Various embodiments of a collector structure are suitable for use in ionic air flow accelerators that use corona ionic technology based on electric field-enhanced ion diffusion. The collector structures are confined in a duct or tube to form an electrohydrodynamic thruster that generates a high-velocity axial airstream.

A first embodiment of the ionic air flow accelerator disclosed herein generates a high velocity air flow along a duct-like structure using electrohydrodynamic thrust. An ion collector electrode surrounds a wire or ribbon electron (or ion emitter) in a substantially coaxial configuration to maximize the alignment between the ion path and the air flow path along the radial direction to maximize efficiency. The symmetry of the coaxial collector uniformly distributes the static field to minimize arcing and maximize the air flow rate.

In some applications, the ionic air flow accelerator may be of small construction. Because it has no moving parts, it may be virtually silent during operation. The simple design is suitable for mass-production, and may be constructed of low cost materials.

The ionic air flow accelerator devices of the type described herein may be suitable for use in the thermal management (convective cooling) of electronic devices. Modern electronic devices contain more circuitry and components than earlier generations of these devices, causing them to generate more heat than their predecessor devices. Examples of heat-generating components include, but are not limited to, integrated circuit (IC) chips, memory chips and various passive devices. These components are part of electronic devices such as cell phones, laptop and ultra-mobile personal computers, personal digital assistance devices, desktop computers, digital light processor (DLP) and liquid crystal display (LCD) projectors and the like that may require innovative cooling methods in order to maximize their operation and performance.

In at least one embodiment of the invention, an electrohydrodynamic fluid accelerator apparatus includes a corona electrode having an axial shape and configured to receive a first voltage. The electrohydrodynamic fluid accelerator apparatus includes a collector electrode disposed coaxially around the at least one corona electrode and configured to receive a second voltage. Application of the first and second voltages on the corona electrode and the collector electrode, respectively, causes fluid proximate to the corona electrode to ionize and travel in a first direction between the corona electrode and the collector electrode, thereby causing other fluid molecules to travel in a second direction to generate a fluid stream. In at least one embodiment of the invention, the ionized fluid proximate to the emitter electrode travels in a radial direction from the corona electrode to the collector electrode, causing the other fluid molecules to travel in an axial direction to thereby generate the fluid stream.

In at least one embodiment of the invention, a method includes generating ions in fluid proximate to a corona electrode having an axial shape. The method includes generating ion flow in a first direction between the corona electrode and a collector electrode. The collector electrode is disposed coaxially around the corona electrode. The method includes generating a fluid flow in a second direction based on the ion flow in the first direction to thereby generate a fluid stream having a first flow rate.

BRIEF DESCRIPTION OF THE DRAWINGS

The present invention may be better understood, and its numerous objects, features, and advantages made apparent to those skilled in the art by referencing the accompanying drawings.

The structure and methods of fabrication of the collector structures described herein are best understood when the following description of several illustrated embodiments is read in connection with the accompanying drawings wherein the same reference numbers are used throughout the drawings to refer to the same or like parts. The drawings are not necessarily to scale; emphasis has instead been placed upon illustrating the structural and fabrication principles of the described embodiments. The drawings include.

The use of the same reference symbols in different drawings indicates similar or identical items.

DESCRIPTION OF THE PREFERRED EMBODIMENT(S)

Figure 1:
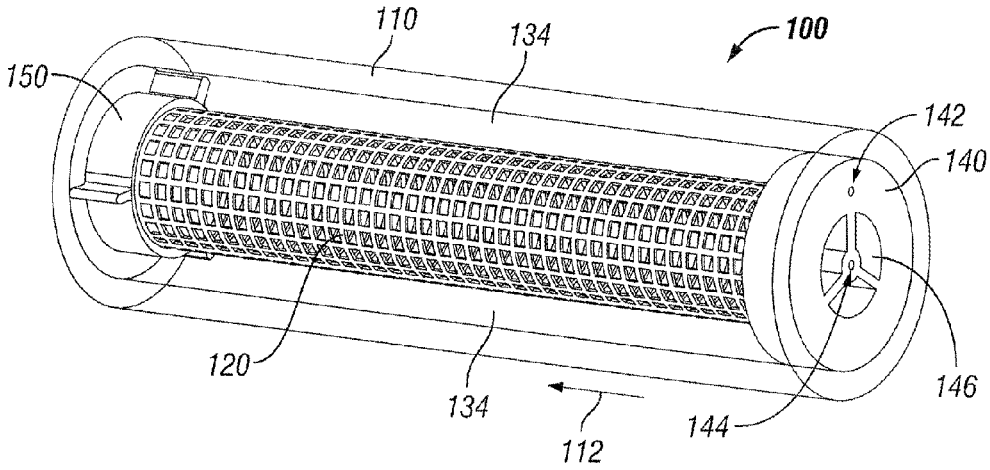
FIG. 1 is a three-dimensional perspective view of a first embodiment of an ionic air flow accelerator, illustrating a first embodiment of a collector structure.
Figure 2:
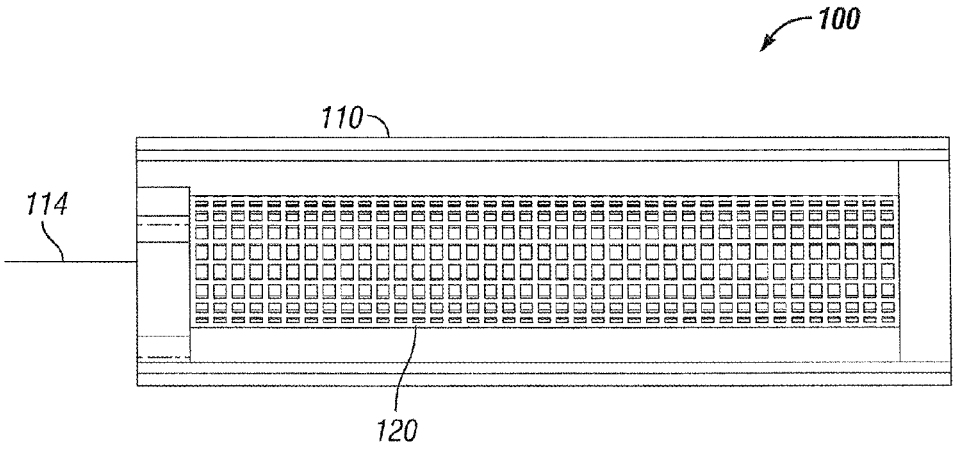
FIG. 2 is a side plan view of the ionic air flow accelerator of FIG. 1.

FIG. 1 illustrates a three-dimensional perspective view of a first embodiment of an ionic air flow accelerator device 100 which occupies a cylindrically-shaped housing 110, hereafter referred to as outer tube 110. FIG. 2 is a side plan view of ionic air flow accelerator device 100. For purposes of showing other structures of ionic air flow accelerator device 100, outer tube 110 is shown as being made of transparent material in FIGS. 1 and 2, but it is understood that it need not be transparent. End-cap 140 is disposed at one end of outer tube 110, and comprises an aperture 144 through which passes a first electrical conductor 114 (shown in FIG. 2). Aperture 144 extends substantially through the entire length of the center portion of cylindrically-shaped housing 110. End-cap 140 also comprises an aperture 142 through which passes a second conductor which is not shown in FIGS. 1 and 2. End-cap 140 further comprises one or more apertures 146 that permit air to enter the interior of ionic air flow accelerator device 100. End-cap 150 is disposed at the other end of outer tube 110 and may comprise one or more apertures, not shown in FIG. 1, through which air may be exhausted.

With continued reference to FIGS. 1 and 2, first electrical conductor 114 passing through cylindrically-shaped housing 110 by way of aperture 144 may be a conductive wire or ribbon that functions as the corona electrode. First electrical conductor 114 is also referred to herein as the emitter or the emitter wire. Emitter wire 114 is typically less than 0.15 mm in diameter, and is charged with a substantial positive voltage, typically 1-5 kV. Emitter wire 114 is surrounded by a collector structure. In at least one embodiment, the collector structure is a perforated, duct-shaped, electrically conductive structure. In at least one embodiment, the collector structure (e.g., collector structure 120) takes the form of a grounded, cylindrically-shaped, conductive metal mesh structure.

Collector structure 120 surrounds the emitter in a substantially coaxial arrangement. The second electrical conductor that enters the interior of outer tube 110 through aperture 142 functions as the electrical conductor to collector structure 120. While the first and second electrical conductors may be referred to as wires, it is understood that neither conductor is required to have any particular shape. The voltage source is not shown in FIG. 1. The symmetry of substantially coaxial collector structure 120 may result in a substantially uniform static field strength distribution around emitter 114 which may maximize the electrohydrodynamic thrust (air movement). The embodiment of collector structure 120 of FIGS. 1 and 2 is open, to allow air to pass freely through the structure. Preferably, collector structure 120 is free of sharp external points and edges, which can cause a phenomenon known as back corona or spark over, which may reduce thrust.

Figure 3:
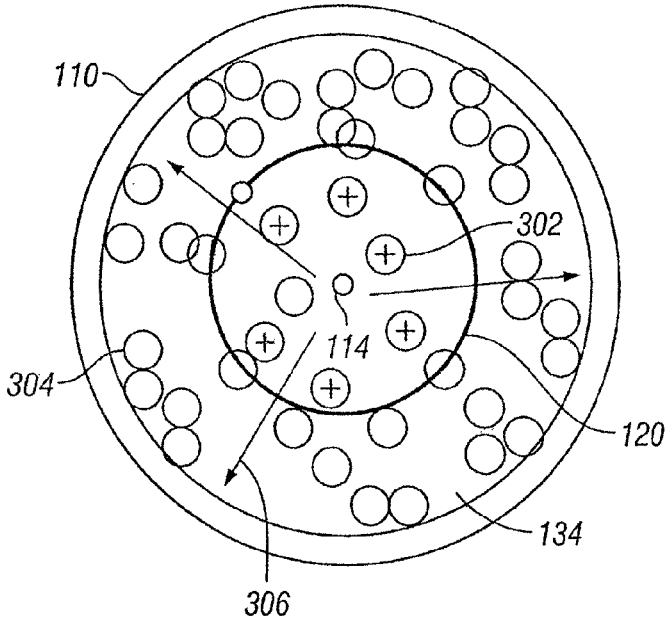
FIG. 3 is a diagrammatic cross-sectional plan view of the ionic air flow accelerator of FIG. 1 showing radially outward air movement.

FIG. 3 is a schematic illustration of a cross-section of ionic air flow accelerator device 100 showing the ion air flow in the interior of outer tube 110. In operation, ionic air flow accelerator device 100 produces a high velocity air flow in the direction of arrow 112 (FIG. 1) in the interior of outer tube 110. Air enters outer tube 110 via apertures 146 in end-cap 142 (FIG. 1). When positive voltage is applied to emitter 114 disposed in the center portion of cylindrically-shaped housing 110, the air near emitter wire 114 ionizes. The positively charged ions 302 are attracted to collector structure 120, and thereby travel radially outward in the direction of arrows 306 from the centrally-located emitter directly to collector structure 120. As ions 302 travel radially outward, they collide with air molecules 304, driving air molecules 304 in the same radial direction. Air molecules 304 pass through the largely open metal mesh of collector structure 120, forming a high-pressure region in outer annulus region 134 bounded by collector structure 120 and outer tube 110, and a corresponding low-pressure region inside collector structure 120. The high pressure air is directed through the exhaust apertures in end cap 150 (FIG. 1) of outer tube 110. In a similar fashion, the low-pressure region inside the metal mesh collector draws air into air intake apertures 146 in end-cap 140 of outer tube 110. This generates an airstream which, in one application, may draw heated air away from an electronic component.

Figure 4:
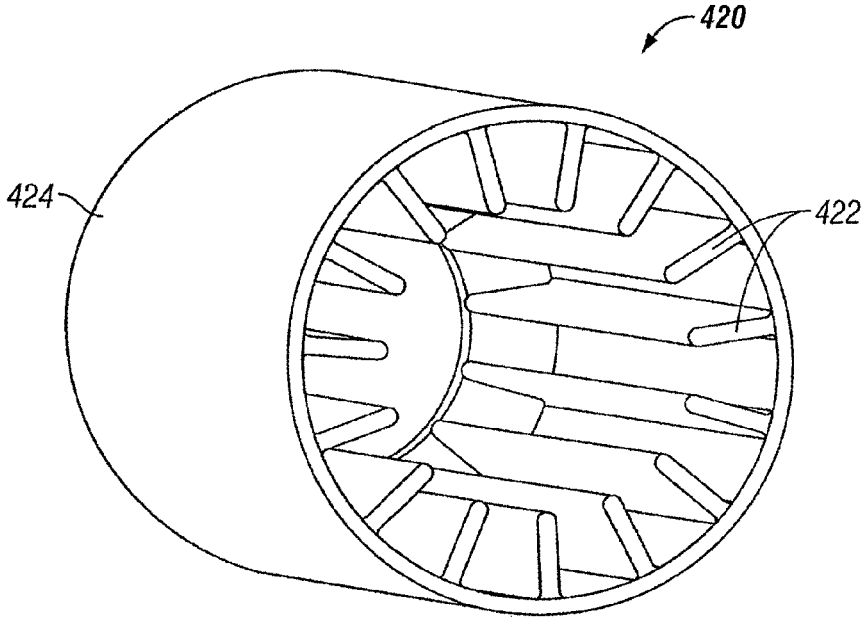
FIG. 4 is a three-dimensional perspective view of a second embodiment of a collector structure for the ionic air flow accelerator of FIG. 1.

FIG. 4 is a three-dimensional perspective view of a second embodiment of a collector structure for a cylindrically-shaped ionic air flow accelerator. Collector structure 420 comprises a series of conductive radial fins 422 disposed in and attached to a solid, grounded conductive tube 424 that surrounds the emitter (not shown in FIG. 4.) Collector structure 420 functions in a manner similarly to that of metal mesh collector structure 120 (FIG. 1). Grounded conductive tube 424 may provide increased safety. The configuration of radial fins 422 may contribute less resistance to the airflow.

Figure 5:
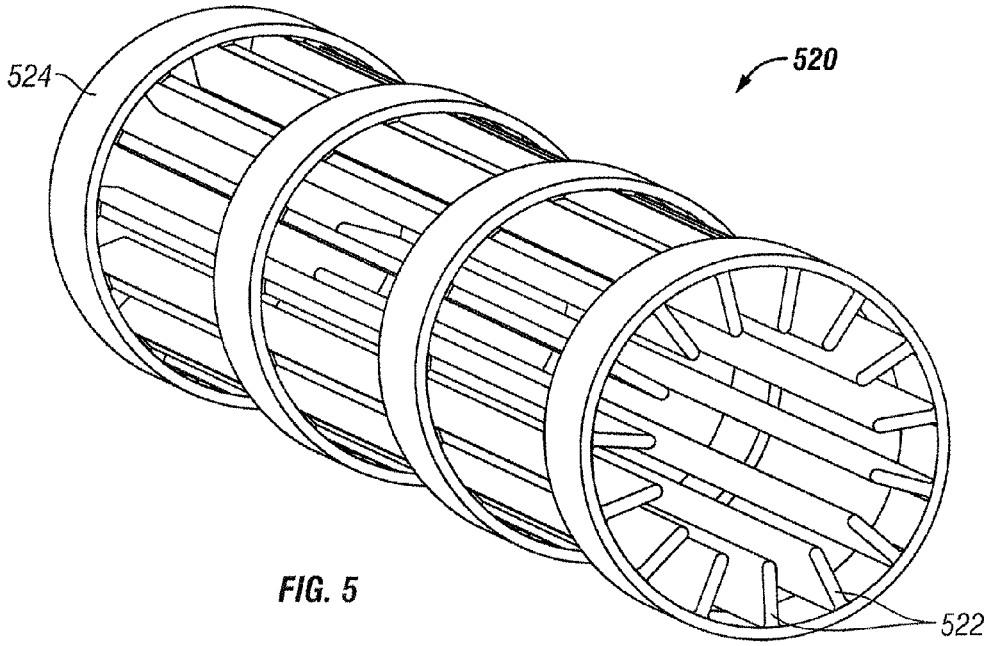
FIG. 5 is a three-dimensional perspective view of a third embodiment of a collector structure for the ionic air flow accelerator of FIG. 1.

FIG. 5 is a three-dimensional perspective view of a third embodiment of a collector structure for a cylindrically-shaped ionic air flow accelerator. Collector structure 520 comprises a series of conductive radial fins 522 disposed in and attached to open grounded conductive tube 524 that surrounds the emitter (not shown in FIG. 5.) Collector structure 520 functions in a manner similarly to that of metal mesh collector structure 120 (FIG. 1). Open grounded conductive tube 524 allows the moving air to exhaust radially. This embodiment pulls ambient air into the cylindrically-shaped structure from one or both ends.

Figure 6:
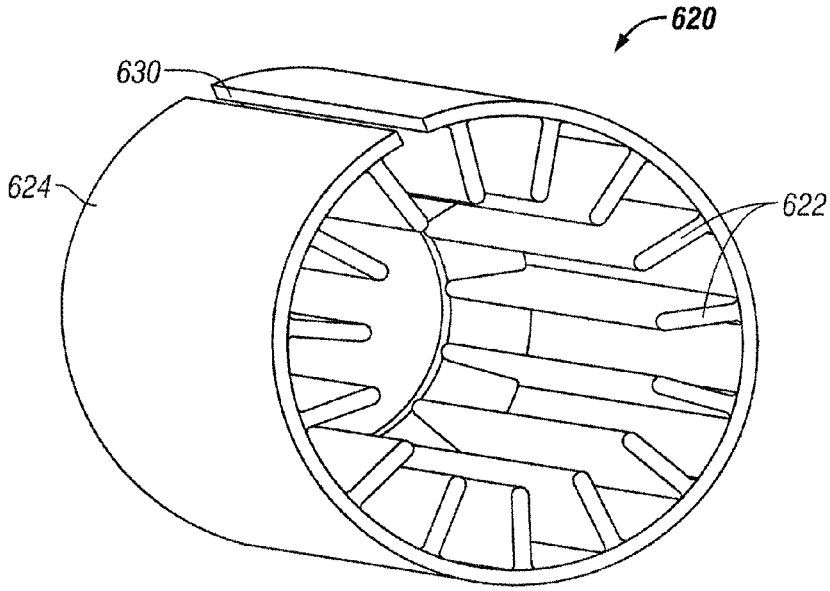
FIG. 6 is a three-dimensional perspective view of a fourth embodiment of a collector structure for the ionic air flow accelerator of FIG. 1.

FIG. 6 is a three-dimensional perspective view of a fourth embodiment of a collector structure for a cylindrically-shaped ionic air flow accelerator. Collector structure 620 comprises a series of conductive radial fins 622 disposed in and attached to substantially solid, grounded conductive tube 624 that surrounds the emitter (not shown in FIG. 6.) Collector structure 620 also comprises axial aperture 630 which confines the exhaust flow to a slot-like vent. Collector structure 620 functions in a manner similarly to that of metal mesh collector structure 120 (FIG. 1). Grounded conductive tube 624 may provide increased safety. The configuration of radial fins 622 may contribute less resistance to the airflow.

The ionic air flow accelerator in any of the embodiments described herein may be constructed of any suitable size and placed in parallel arrays of as many as required by the application. The shape of the ionic air flow accelerator in any of the embodiments described herein may be adapted to fit the space available in the application. That is, the shape is flexible and is not restricted or limited to a single straight cylindrical shape, as shown in the figures. The emitter wire, along with the coaxial collector, can be bent around corners and shaped as required to fit into the space available in the application.

The simple structure of ionic air flow accelerator in any of the embodiments described herein may be constructed with conventional materials. The structure's components comprise a wire or ribbon emitter, a supporting housing, a die cast metal, stamped or molded and plated collector, and a high-voltage DC power supply.

Figure 7:
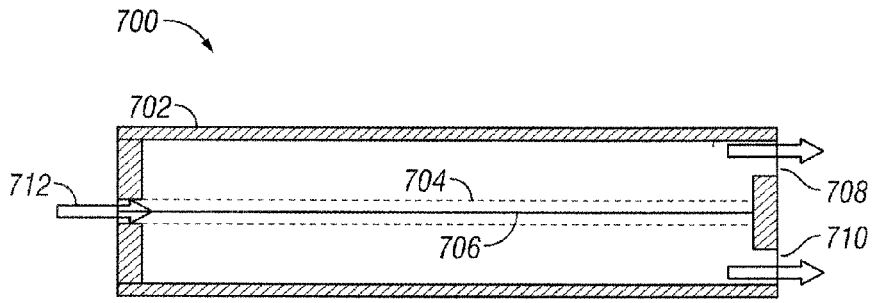
FIG. 7 is a side plan view of a fluid accelerator consistent with at least one embodiment of the invention.

Referring to FIG. 7, an exemplary ionic fluid flow accelerator (e.g., ionic air flow accelerator portion 700) includes a wire-shaped electrode (e.g., corona electrode 706) surrounded by a cylindrically-shaped collector electrode (e.g., collector electrode 704), which is enclosed in a cylindrical housing structure (e.g., housing 702). Collector electrode 704 is disposed coaxially around corona electrode 706, i.e., collector electrode 704 and corona electrode 706 share a common axis, e.g., the wire-shaped electrode is coincident with the axis of the collector electrode.

As referred to herein, a duct-shaped structure has a surface that substantially encloses an axis along the length of the axis. A cross-section of the duct-shaped structure is a surface representing the intersection of the duct-shaped structure and a plane perpendicular to the axis. The duct-shaped structure may have a circular, oval, rectangular, or other suitably-shaped cross-section. As referred to herein, a cylindrically-shaped structure is a duct-shaped structure that has a circular cross-section. In general, the radius, diameter, height, or width of cross-sections of the duct-shaped structure need not be constant over the length of the duct-shaped structure, although those dimensions may be constant.

When a sufficient potential difference (e.g., a potential difference in the range of kiloVolts) is generated between the corona electrode 706 and collector electrode 704, corona discharge produces ionized molecules in the air surrounding corona electrode 706 and produces an electric field between the electrodes. In general, those ions have the same electrical polarity as corona electrode 706. When the ions collide with other air molecules, the ions impart to those other air molecules momentum toward collector electrode 704 and also transfer some electric charge to those other air molecules, thereby creating additional ions. The ions are attracted toward collector electrode 704, a low fluid pressure region is formed around corona electrode 706, and a high fluid pressure region is formed between collector electrode 704 and housing 702.

Air flows in and out of the ionic air flow accelerator portion 700 via apertures in the cylindrically-shaped housing. For example, the accelerator portion end-structures include input aperture 712, exit aperture 708, and exit aperture 710. In at least one embodiment of an ionic fluid flow accelerator, input aperture 712 is proximate to the low fluid pressure region surrounding the corona electrode 706, and exit apertures 708 and 710 are proximate to the high fluid pressure region generated between the collector electrode 704 and housing 702. Accordingly, air flowing into air flow accelerator portion 700 is accelerated by the effects of the potential difference applied to corona electrode 706 and collector electrode 704.

Although exit apertures 708 and 710 are disposed in end-structures that are orthogonal to an axis of housing 702, in at least one embodiment of an ionic fluid flow accelerator, one or more exit apertures may be disposed in a surface of the duct-shaped housing that is parallel to the axis. The direction of exiting airflow may be changed by changing the location of one or more exit apertures along the duct-shaped housing, which are proximate to the high fluid pressure region within. In at least one embodiment, corona electrode 706 and collector electrode 704 are formed by electrically and thermally conductive materials (e.g., copper or other suitable conductors). In at least one embodiment, housing 702 is formed from an electrically conductive material and is coupled to receive a voltage less than or equal to the voltage received by collector electrode 704, which is less than the voltage received by corona electrode 706. In at least one embodiment, housing 702 is formed from an electrically insulating material. Other structures that may be included in an ionic fluid flow accelerator portion for structural purposes (e.g., to provide support to a corona electrode wire) may be formed from electrically insulating but thermally conductive materials.

Figure 8:
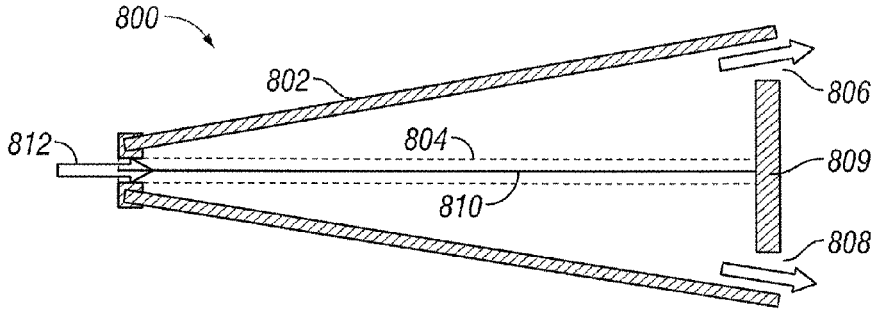
FIG. 8 is a side plan view of a fluid accelerator including a flared housing consistent with at least one embodiment of the invention.

Referring to FIG. 8, in at least one embodiment of an ionic fluid flow accelerator, geometry of the duct-shaped housing may be varied to increase fluid flow in a particular direction. For example, ionic fluid flow accelerator portion 800 includes a flared duct-shaped housing (e.g., duct-shaped housing 802) having a flared geometry, i.e., the diameter of a cross-section of the duct-shaped housing changes with axial position along the duct-shaped housing. The flared geometry promotes airflow in an axial direction. For example, a cross-section near the input to the duct-shaped housing (e.g., near input aperture 812) has a diameter that is smaller than the diameter of a cross-section of the duct-shaped housing that is closer to an exit of the duct-shaped housing (e.g., exit aperture 806 or exit aperture 808).

Figure 9:
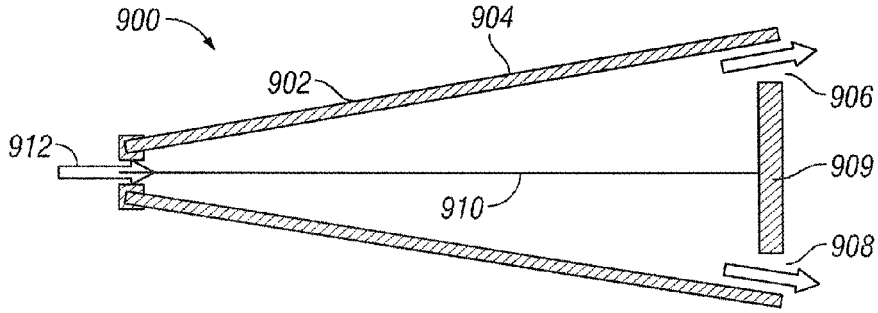
FIG. 9 is a side plan view of a fluid accelerator including a flared collector electrode consistent with at least one embodiment of the invention.
Figure 10:
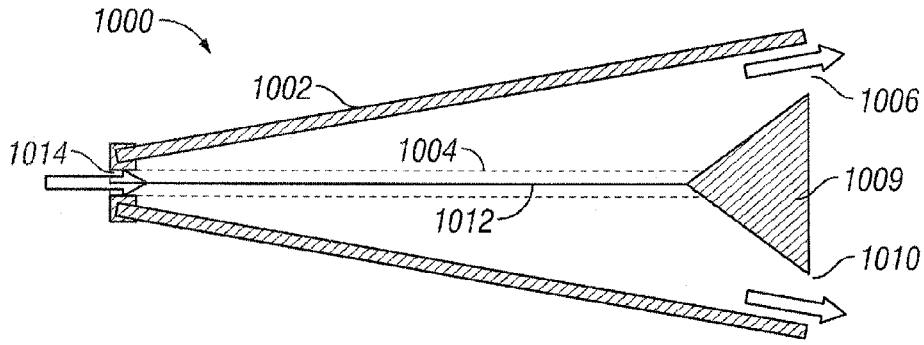
FIG. 10 is a side plan view of a fluid accelerator including a flow conditioning structure consistent with at least one embodiment of the invention.
Figure 11:
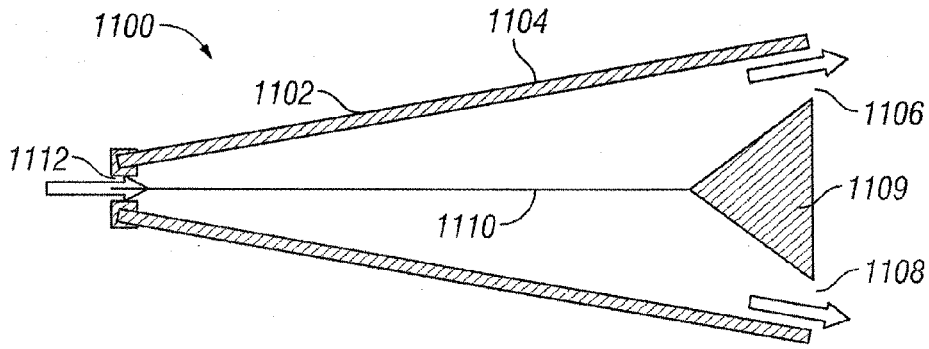
FIG. 11 is a side plan view of a fluid accelerator including a flow conditioning structure consistent with at least one embodiment of the invention.

Referring to FIG. 9, in at least one embodiment of an ionic fluid accelerator, the collector electrode is the housing of the apparatus and no separate housing is used. For the collector electrode (e.g., collector electrode 904) that is the same surface as the housing, the collector electrode itself may have a flared geometry, e.g., a cross-section near the input to the collector electrode (e.g., input aperture 912) has a diameter that is smaller than the diameter of a cross-section of the collector electrode that is closer to an exit of the collector electrode (e.g., exit aperture 906 or exit aperture 908). That is, the diameter of the collector electrode increases with distance along the axis (e.g., the corona electrode 910) from input aperture 912. When ions or other fluid molecules collide with the angled surface, some of the force of the collision with the angled surface provides momentum to the ions or other fluid molecules in a direction of the fluid flow, thereby improving the rate of fluid flow and/or fluid flow efficiency of ionic fluid flow accelerator portions 800 and 900 of FIGS. 8 and 9, respectively, as compared to ionic fluid flow accelerator portion 700 of FIG. 7.

Referring to FIG. 9, ionic fluid flow accelerator portion 900 is not symmetric because the distance between the corona electrode and ion emitter collector is not uniform. Thus, the electric field density between the electrodes may not be uniform. However, note that in at least one embodiment of an ionic fluid flow accelerator, corona electrode 910 is a wire with a non-zero resistance and may have a voltage drop from one end of the wire to another (i.e., the voltage of the emitter electrode may vary with distance along the emitter electrode). Since the electric field density also varies as a function of voltage over distance, the effects of the non-uniform diameter on the electric field may be altered by choosing the direction of any current generated in the corona electrode (e.g., a positive voltage drop across the wire electrode from exit to entrance of the collector electrode, i.e., where the voltage of the wire electrode portion at the exit of the accelerator portion is greater than the voltage of the wire electrode portion at the entrance to the accelerator portion). Another technique for varying effects on the electric field density, which may be used to adjust or increase fluid flow, includes using a corona electrode structure that has a resistance that varies with axial distance. For example, one or more particular portions of a corona electrode may have a resistance selected based on a diameter of a corresponding portion of a collector electrode having non-uniform diameter. Thus, the uniformity of an electric field between points on the corona electrode and corresponding points on the collector electrode may be increased by using one or more corona electrode portions having corresponding resistances that generate a variation in current flow along a length of the corona electrode.

Referring to FIGS. 7-11, a technique improves flow efficiency of ionic fluid flow accelerator portion 1000 and 1100 as compared to the flow efficiency of ionic fluid flow accelerator portions 700, 800, and 900. In at least one embodiment of an ionic fluid flow accelerator, flow resistance at the exit of the duct-shaped housing is reduced by including a flow conditioning structure (e.g., flow conditioning structures 1009 and 1109) at the exit of the duct-shaped housing instead of a surface orthogonal to a target direction of air flow (e.g., end surfaces 709, 809, and 909). End surfaces 709, 809, and 909 may contribute to creation of local vortices that increase the air resistance and reduce air flow. Flow conditioning structures 1009 and 1109 are gradually sloped at a suitable angle to condition air flow in a target flow direction, thereby improving rate of fluid flow and/or flow efficiency of ionic fluid flow accelerator portions 1000 and 1100, as compared to the flow efficiency of ionic fluid flow accelerator portions 700, 800, and 900.

Figure 12:
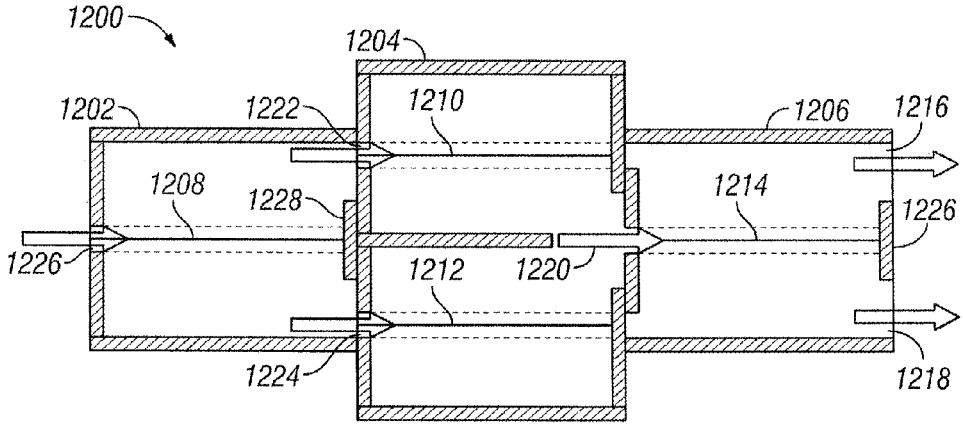
FIG. 12 is a side plan view of a multi-stage fluid accelerator including a flow conditioning structure consistent with at least one embodiment of the invention.
Figure 13:
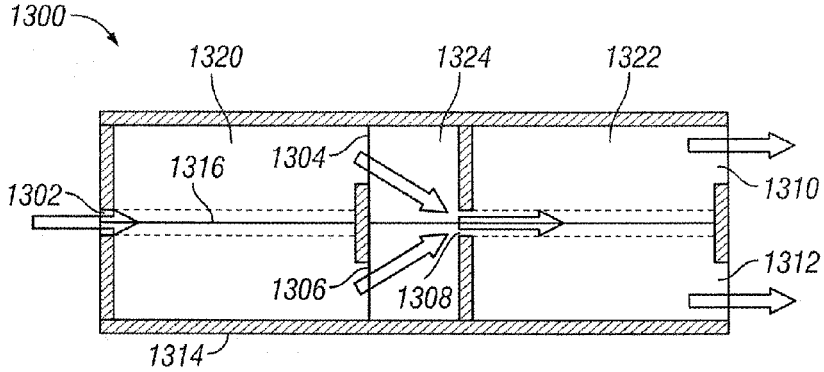
FIG. 13 is a side plan view of a multi-stage fluid accelerator including a flow conditioning structure consistent with at least one embodiment of the invention.

In at least one embodiment of an ionic fluid flow accelerator, multiple accelerator stages may be used to increase force on the fluid or work done on the fluid. Referring to FIG. 12, multi-stage accelerator portion 1200 includes stages 1202, 1204, and 1206. Stages 1202 and 1206 each include a single corona electrode, e.g., corona electrodes 1208 and 1214, respectively, which are surrounded by corresponding collector electrodes and duct-shaped housings. Stage 1204 includes multiple chambers. Each chamber includes a corresponding corona electrode (e.g., corona electrodes 1210 or 1212) and a corresponding collector electrode. Air flows through the multiple chambers to a common exit aperture 1220, which is located in a high fluid pressure region of stage 1204. The air enters stage 1206 from stage 1204 into a low fluid pressure region of stage 1206. Air enters each successive stage at a low fluid pressure region of the stage and exits each successive stage at a high fluid pressure region of the stage. Referring to FIG. 13, multi-stage accelerator portion 1300 includes single corona electrode stages 1320 and 1322, and a transition stage 1324. Transition stage 1324 routes the air flow from the high fluid pressure region of stage 1320 at the exit aperture of stage 1320 to the entrance aperture 1308 at the low fluid pressure region of stage 1322. As a result, the flow rate and/or outlet pressure of multi-stage accelerator portion 1200 and the flow rate and/or outlet pressure of multi-stage accelerator portion 1300 are each greater than the flow rate and/or outlet pressure, respectively, achieved by a single stage of those acceleration portions.

Note that embodiments of the multi-stage accelerator portions of FIGS. 12 and 13 may be flared and/or include flow conditioning structures that decrease flow resistance between stages. In at least one embodiment of an ionic fluid flow accelerator, a collector electrode may be a heat sink or thermal exchange surface that is used to cool an electronic device. In at least one embodiment of an ionic fluid flow accelerator, the walls of the duct-shaped housing and/or collector electrode serve as a heat sink surface.

The description of the invention set forth herein is illustrative, and is not intended to limit the scope of the invention as set forth in the following claims. For example, while the invention has been described in an embodiment in which the corona electrode has a positive polarity based on a particular potential difference of the corona electrode and collector electrode, one of skill in the art will appreciate that the teachings herein can be utilized with other potential differences and that a negative polarity may be used. In addition, while the invention has been described in embodiments in which air is the fluid that is ionized and accelerated, one of skill in the art will appreciate that the teachings herein can be utilized with other fluids. Moreover, while the invention has been described in embodiments in which the corona electrode is wire-shaped and the collector electrode and any housing are cylindrical, one of skill in the art will appreciate that the teachings herein can be utilized with a corona electrode, a collector electrode, and/or housing have other suitable shapes (e.g., the collector electrode and any housing are duct-shaped). Variations and modifications of the embodiments disclosed herein may be made based on the description set forth herein, without departing from the scope and spirit of the invention as set forth in the following claims.

What is claimed is:

1. An electrohydrodynamic fluid accelerator apparatus comprising:

a corona electrode having a longitudinal extent and configured to receive a first voltage; and a collector electrode disposed coaxially around and radially surrounding at least a portion of the longitudinal extent of the corona electrode and configured to receive a second voltage, wherein application of the first and second voltages on the corona electrode and the collector electrode, respectively, causes fluid along the longitudinal extent of the corona electrode to ionize and travel in a first, generally radial direction between the corona electrode and the collector electrode, causing other fluid molecules to travel in a second direction to generate a fluid stream, and wherein the collector electrode is at least partially formed by a series of conductive radial fin structures and a solid, conductive duct-shaped portion.

2. The electrohydrodynamic fluid accelerator apparatus, as recited in claim 1, wherein the ionized fluid proximate to the emitter electrode travels in a radial direction from the corona electrode to the collector electrode, thereby causing the other fluid molecules to travel in an axial direction to thereby generate the fluid stream.

3. The electrohydrodynamic fluid accelerator apparatus, as recited in claim 1, wherein the collector electrode includes at least one cylindrically-shaped portion.

4. The electrohydrodynamic fluid accelerator apparatus, as recited in claim 1, further comprising:

a first end-structure disposed at a first end of the collector electrode and including at least one aperture configured to permit a fluid to enter the collector electrode; and a second end-structure disposed at a second end of the collector electrode and including at least one aperture.

5. The electrohydrodynamic fluid accelerator apparatus, as recited in claim 4, wherein the first aperture of the first end-structure is disposed proximate to a region of low fluid pressure and the at least one aperture of the second end-structure is disposed proximate to a region of high fluid pressure.

6. The electrohydrodynamic fluid accelerator apparatus, as recited in claim 4, wherein the second end-structure has a sloped profile.

7. The electrohydrodynamic fluid accelerator apparatus, as recited in claim 1, further comprising:

a housing disposed coaxially around the corona electrode, to thereby form an outer region between the housing and the collector electrode.

8. The electrohydrodynamic fluid accelerator apparatus, as recited in claim 7, wherein the housing, is a heat sink surface in a cooling apparatus including the electrohydrodynamic fluid accelerator apparatus.

9. The electrohydrodynamic fluid accelerator apparatus, as recited in claim 7, further comprising:

a first end structure disposed at a first end of the housing and including at least one aperture configured to permit a fluid to enter the collector electrode; and a second end-structure disposed at a second end of the housing and including at least one aperture configured to permit the fluid to exit the housing.

10. The electrohydrodynamic fluid accelerator apparatus, as recited in claim 9, wherein the first aperture of the first end-structure is disposed proximate to a region of low fluid pressure and the at least one aperture of the second end-structure is disposed proximate to a region of high fluid pressure.

11. The electrohydrodynamic fluid accelerator apparatus, as recited in claim 7, wherein the housing has a first diameter at a first location and a second diameter at a second location, the first diameter being smaller than the second diameter and the first location being closer to a fluid input to the housing than the second diameter.

12. The electrohydrodynamic fluid accelerator apparatus, as recited in claim 1, wherein the collector electrode has a first diameter at a first location and a second diameter at a second location, the first diameter being smaller than the second diameter and the first location being closer to a fluid input to the collector electrode than the second diameter.

13. The electrohydrodynamic fluid accelerator apparatus, as recited in claim 1, wherein the collector electrode is at least partially formed by an electrically conductive, perforated structure.

14. The electrohydrodynamic fluid accelerator apparatus, as recited in claim 1, wherein the corona electrode and the collector electrode form a first stage of the electrohydrodynamic fluid accelerator apparatus and one or more exit apertures of the first stage are adjacent to one or more entrance apertures of at least one additional stage of the electrohydrodynamic fluid accelerator apparatus.

15. The electrohydrodynamic fluid accelerator apparatus, as recited in claim 1, wherein the collector electrode, is a heat sink surface in a cooling apparatus including the electrohydrodynamic fluid accelerator apparatus.

16. The electrohydrodynamic fluid accelerator apparatus, as recited in claim 1, wherein the conductive duct-shaped portion is substantially solid and includes an axial aperture.

17. An electrohydrodynamic fluid accelerator apparatus comprising:

a corona electrode having a longitudinal extent and configured to receive a first voltage; and a collector electrode disposed coaxially around and radially surrounding at least a portion of the longitudinal extent of the corona electrode and configured to receive a second voltage, wherein application of the first and second voltages on the corona electrode and the collector electrode, respectively, causes fluid along the longitudinal extent of the corona electrode to ionize and travel in a first, generally radial direction between the corona electrode and the collector electrode, causing other fluid molecules to travel in a second direction to generate a fluid stream, and wherein the collector electrode is at least partially formed by a series of conductive radial fin structures and an open, conductive, cylindrically-shaped portion including a plurality of spaced, ring-shaped portions.

18. The electrohydrodynamic fluid accelerator apparatus, as recited in claim 17, wherein the corona electrode includes a wire-shaped portion.

19. The electrohydrodynamic fluid accelerator apparatus, as recited in claim 17, wherein the corona electrode is configured to receive a substantial voltage and the collector electrode is configured to be an electrical ground.

20. The electrohydrodynamic fluid accelerator apparatus, as recited in claim 1, wherein a direction of fluid flow is substantially orthogonal to a direction of ion flow.

21. A method comprising:

generating ions in fluid proximate to a corona electrode having a longitudinal extent;

generating ion flow in a first, generally radial direction between the corona electrode and a collector electrode, the collector electrode being disposed coaxially around and radially surrounding at least a portion of the corona electrode; and generating a fluid flow in a second direction based on the ion flow in the first direction to thereby generate a fluid stream having a first flow rate, wherein generating the fluid flow includes forming a high fluid pressure region proximate to the collector electrode, and wherein the high fluid pressure region is outside the collector electrode and between the collector electrode and a housing disposed coaxially around the collector electrode.

22. The method, as recited in claim 21, wherein generating the ion flow includes forming a low fluid pressure region proximate to the corona electrode.

23. The method, as recited in claim 21, wherein generating the fluid flow includes forming a high fluid pressure region proximate to the collector electrode.

24. The method, as recited in claim 21, further comprising:

increasing one or more of the rate of the fluid flow and outlet pressure, from the first fluid flow rate to a second fluid flow rate and from a first outlet pressure to a second outlet pressure, respectively, using at least one additional corona electrode and at least one additional collector electrode in at least one stage disposed contiguously to the corona electrode and collector electrode.

25. The method, as recited in claim 21, further comprising:

increasing a rate of fluid flow at an exit aperture of an apparatus including the corona electrode and collector electrode using an end-structure having a sloped profile, wherein the rate of fluid flow is greater than fluid flow using an end-structure having a vertical profile.

26. The method, as recited in claim 21, further comprising:

increasing a rate of fluid flow using a housing disposed coaxially around the corona electrode, the housing having a non-constant diameter, wherein the rate of fluid flow is greater than fluid flow using a housing having a constant diameter.

27. The method, as recited in claim 21, wherein the collector electrode has a non-constant diameter.

28. A method comprising:

generating ions in fluid proximate to a corona electrode having a longitudinal extent;

generating ion flow in a first, generally radial direction between the corona electrode and a collector electrode, the collector electrode being disposed coaxially around and radially surrounding at least a portion of the corona electrode;

generating a fluid flow in a second direction based on the ion flow in the first direction to thereby generate a fluid stream having a first flow rate; and increasing a rate of fluid flow using a housing disposed coaxially around the corona electrode, the housing having a non-constant diameter, wherein the rate of fluid flow is greater than fluid flow using a housing having a constant diameter; and increasing the uniformity of an electric field between points on the corona electrode and corresponding points on the collector electrode by using one or more corona electrode portions having corresponding resistances that generate a variation in current flow along a length of the corona electrode.

* * * * *